US007523527B2

(12) United States Patent
Garber

(10) Patent No.: US 7,523,527 B2
(45) Date of Patent: Apr. 28, 2009

(54) CLASP FOR CHAINS AND THE LIKE

(76) Inventor: Michael I. Garber, 355 Enclave Cir., Atlanta, GA (US) 30342

( * ) Notice: Subject to any disclaimer, the term of this patent is extended or adjusted under 35 U.S.C. 154(b) by 154 days.

(21) Appl. No.: 11/466,263

(22) Filed: Aug. 22, 2006

(65) Prior Publication Data

US 2008/0047111 A1 Feb. 28, 2008

(51) Int. Cl.
*A44C 5/20* (2006.01)

(52) U.S. Cl. ..... 24/303; 24/587.11

(58) Field of Classification Search ..... None
See application file for complete search history.

(56) References Cited

U.S. PATENT DOCUMENTS

| | | | |
|---|---|---|---|
| 4,246,679 | A | 1/1981 | Monett |
| 5,050,276 | A | 9/1991 | Pemberton |
| 5,099,659 | A | 3/1992 | Carranza et al. |
| 5,197,168 | A | 3/1993 | Levy |
| 5,722,260 | A | 3/1998 | Mangano |
| 5,979,196 | A | 11/1999 | Vanmoor |
| 6,170,131 | B1 | 1/2001 | Shin |
| 6,640,398 | B2 | 11/2003 | Hoffman |
| 6,981,391 | B2 | 1/2006 | Suzuki |
| 2004/0079111 | A1 | 4/2004 | Hartgrove |
| 2005/0023841 | A1 | 2/2005 | Chen |
| 2005/0252239 | A1 | 11/2005 | Ward et al. |
| 2006/0048543 | A1 | 3/2006 | Kessler |
| 2006/0075781 | A1 | 4/2006 | Kretchmer et al. |

*Primary Examiner*—Jack W. Lavinder
(74) *Attorney, Agent, or Firm*—Bryan W. Bockhop; Michael I. Garber

(57) ABSTRACT

A clasp for securing two items together includes a first section, a second section, least one pin and a force mechanism. The first section defines a cylindrical passage opening to the first face. The cylindrical passage defines at least one longitudinal J-shaped groove disposed longitudinally along the cylindrical passage. The J-shaped groove includes a main longitudinal portion, a transverse portion and a hooked portion. The second section has a top portion and a piston portion. The piston portion is complementary in dimension to the cylindrical passage. The pin extends transversely to the piston portion and is complementary to the J-shaped groove. The force mechanism applies a repulsive force between the second section and the first section so that when the pin is aligned with the hooked poration, the repulsive force drives the pin into the hooked portion, thereby inhibiting the second section from disengaging the first section.

7 Claims, 3 Drawing Sheets

CLASP FOR CHAINS AND THE LIKE

BACKGROUND OF THE INVENTION

1. Field of the Invention

The present invention relates to connectors and, more specifically, to a clasp for securing chains and the like.

2. Description of the Prior Art

The ends of chains, lines and ropes are often secured to each other objects through use of some sort of securing mechanism. For example, chains used in jewelry often employ spring-loaded clips that hook into a loop to secure the chain around the neck of the wearer. Another example of a common jewelry chain securing mechanism is a clasp in which one end of the chain includes a male-threaded member and the other end of the chain includes a female-threaded member that is complimentary in shape to the male-threaded member. The female-threaded member is placed in contact with the male-threaded member and twisted relative thereto, causing the threads of the male-threaded member to engage the threads of the female-threaded member, thereby securing the members to each other.

Other types of objects, such as large scale chains, lines, ropes, cable and the like employ clasps or other types of connectors that are used to secure the objects to other objects and themselves. In some applications, such as sailing, it is important to have lines that can be connected quickly and securely.

These types of clasps have the disadvantage of being difficult to use, especially for users having poor near-vision eyesight and arthritis, especially when the clasps are small (as with many jewelry chains). The threaded clasps also have the disadvantage of sometimes becoming unseated as a result of vibration causing the threads to disengage.

Therefore, there is a need for a clasp that is easy to use and that provides secure engagement.

SUMMARY OF THE INVENTION

The disadvantages of the prior art are overcome by the present invention which, in one aspect, is a clasp for securing two items together that includes a first section, a second section, least one pin and a force mechanism. The first section has a first face and defines a cylindrical passage opening to the first face. The cylindrical passage has a base surface and defines at least one longitudinal J-shaped groove disposed longitudinally along the cylindrical passage. The J-shaped groove includes a main longitudinal portion, a transverse portion in communication with the longitudinal portion and a hooked portion in communication with the transverse portion that is parallel to, and shorter than, the longitudinal portion. The second section has a top portion and a piston portion extending longitudinally therefrom. The piston portion is complementary in dimension to at least a portion of the cylindrical passage and has a bottom surface. The pin extends transversely to the piston portion and is complementary in dimension to at least a portion of the J-shaped groove. The force mechanism applies a repulsive force between the second section and the first section so that when the pin is aligned with the hooked poration, the repulsive force drives the pin into the hooked portion, thereby inhibiting the second section from disengaging the first section.

In another aspect, the invention is a linkage that includes a linkable object, a first section, a first secured link, a second section, a second secured link, at least one pin and a force mechanism. The linkable object includes a first portion terminating in a first end and a second portion terminating in an opposite second end. The first section has a first face and an opposite second face and defines a cylindrical passage opening to the first face. The cylindrical passage has a base surface and defines at least one longitudinal J-shaped groove disposed longitudinally along the cylindrical passage. The J-shaped groove includes a main longitudinal portion, a transverse portion in communication with the longitudinal portion and a hooked portion in communication with the transverse portion that is parallel to, and shorter than, the longitudinal portion. The first secured link is affixed to the second face of the first section and is engaged with the first end of the linkable object. The second section has a top portion and a piston portion extending longitudinally therefrom. The piston portion is complementary in dimension to at least a portion of the cylindrical passage and has a bottom surface. The second section has a first face. The second secured link is affixed to the first face of the second section. The second secured link is engaged with the second end of the linkable object. The pin extends transversely to the piston portion and is complementary in dimension to at least a portion of the J-shaped groove. The force mechanism applies a repulsive force between the second section and the first section so that when the pin is aligned with the hooked poration, the repulsive force drives the pin into the hooked portion, thereby inhibiting the second section from disengaging the first section.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
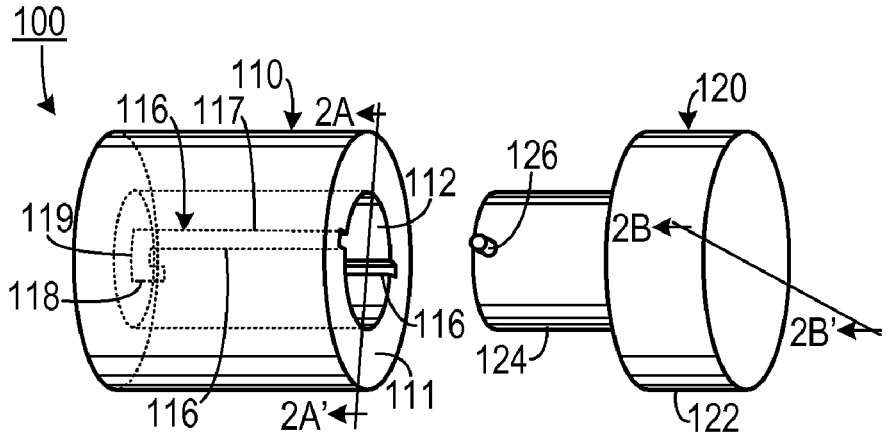
FIG. 1 is a perspective view of a clasp.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Figure 2A:
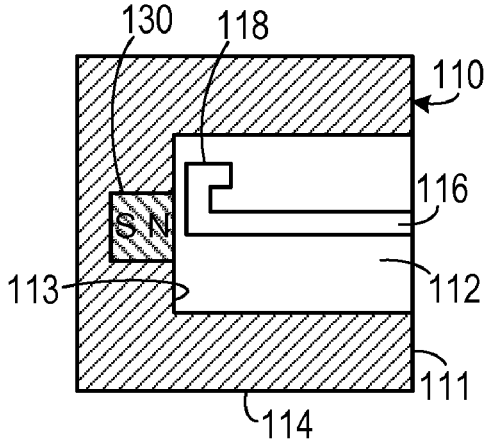
FIG. 2A is a cross-sectional view of the clasp shown in FIG. 1, taken along line 2A-2A'.
Figure 2B:
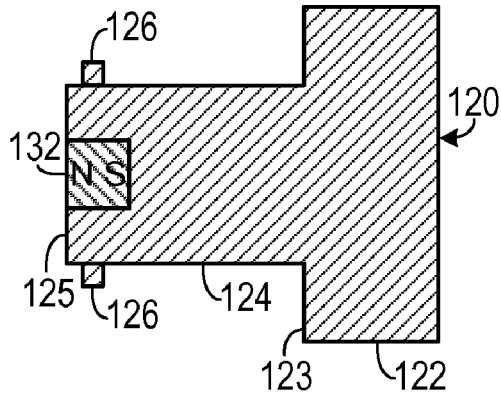
FIG. 2B is a cross-sectional view of the clasp shown in FIG. 1, taken along line 2B-2B'.
Figure 3:
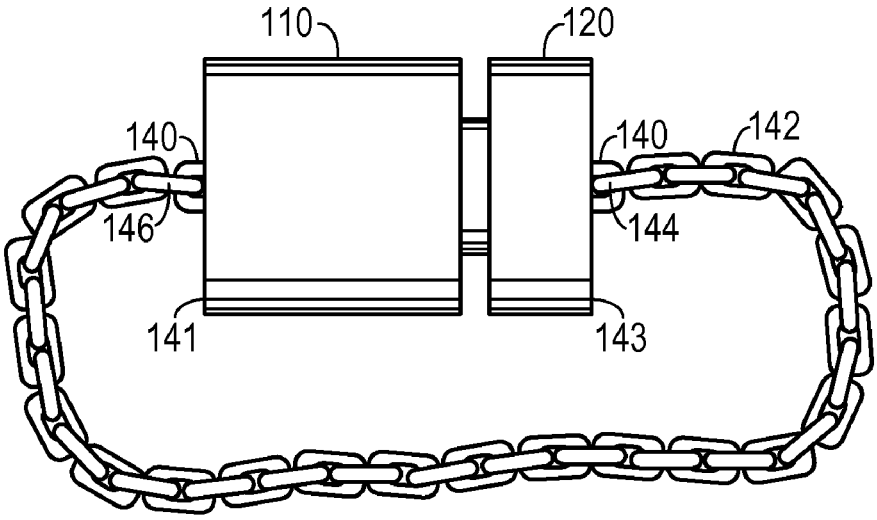
FIG. 3 is an elevational view of a clasp used to secure two ends of a chain.

Referring to FIGS. 1-3, one embodiment of the invention includes a clasp 100 that may be used to secure chains, such as chains used with jewelry, and other types of objects. It includes a first section 110 and a second section 120. Both the first section 110 and the second section 120 are attachable to a chain 142 through a secured link 140.

The first section 110 has an outer surface 114 that ends at a top face 111 and defines a cylindrical passage 112, having a base surface 113, passing longitudinally through a portion of the first section 110 and opening to the top face 111. At least one J-shaped longitudinal groove 116 is defined by the inner wall of the cylindrical passage 112. (Two oppositely disposed and mirrored longitudinal grooves 116 are shown in the present embodiment.)

The longitudinal groove 116 includes a main longitudinal portion 117 and a transverse portion 119 that is in communication with the longitudinal portion 117. A hooked portion 118 is in communication with the transverse portion 119 and is parallel to, and shorter than, the longitudinal portion 117.

The second section 120 includes a top portion 122 having a bottom surface 123 and a narrower piston portion 124, having a bottom surface 125, extending longitudinally therefrom. The piston portion 124 has dimensions that are complimentary to the dimensions of the cylindrical passage 112, allowing mating engagement therein. At least one pin 126 extends from the piston portion 124 so as to be engageable with the longitudinal groove 116.

In one embodiment, as shown in FIG. 3, a linkable object 142 (e.g., a chain 142, a cable, a line or the like) includes a first portion terminating in a first end 146 and a second portion terminating in an opposite second end 144. A first secured link 140 is affixed to the second face 141 of the first section 110 and the first secured link 140 is engaged with the first end 146 of the linkable object. Similarly, a second secured 140 link is affixed to the first face 143 of the second section 120 and is engaged with the second end 144 of the linkable object 142. The linkable object 142 is not necessarily a single contiguous thing, but may be two separate things that, when secured together by the embodiment of the invention for a linkable object.

Figure 4A:
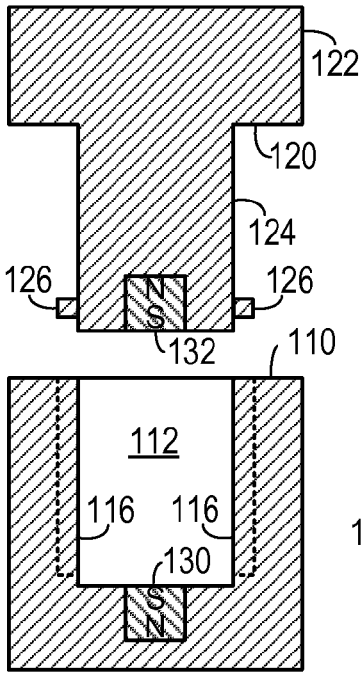
FIGS. 4A-4C are cross-sectional views of a clasp in use.
Figure 4B:
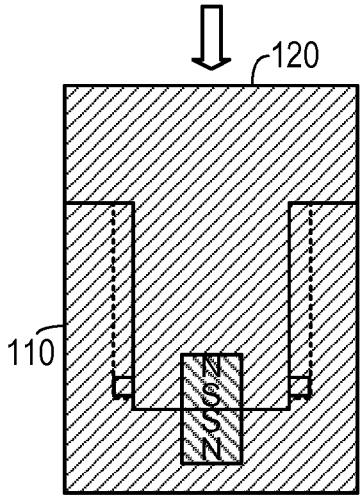
Figure 4C:
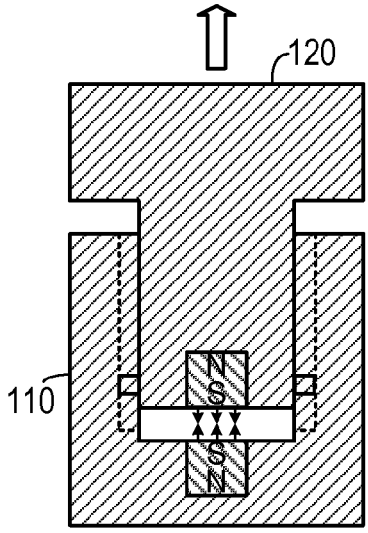

As shown in FIGS. 4A-4C, a force member provides force that tends to push the second section 120 away from the first section 110. In one embodiment, the force member includes a first magnet 130 polarized in a first manner disposed in the cylindrical passage 112 and a second magnet 132 polarized in the first manner and disposed at the end of the piston portion 122. Because of their like polarities, the first magnet 130 exerts an opposing force on the second magnet 132.

To fasten the clasp, the user pushes the piston portion 122 substantially all of the way into the cylindrical passage 112, with the pins 126 engaging the grooves 116. The user then twists the second section 120 with respect to the first section 120 until the pins 126 are aligned with the hooked portion 118. The user then releases the clasp and the magnets 130 and 132 force the pins 126 into the hooked portion 118, thereby securing the second section 120 to the first section 110. To release the clasp 100, the user pushes the second section 120 into the first section 110, twists the second section 120 relative to the first section 110 and releases both sections. The magnets 130 and 132 force the second section 120 away from the first section 110.

Figure 5:
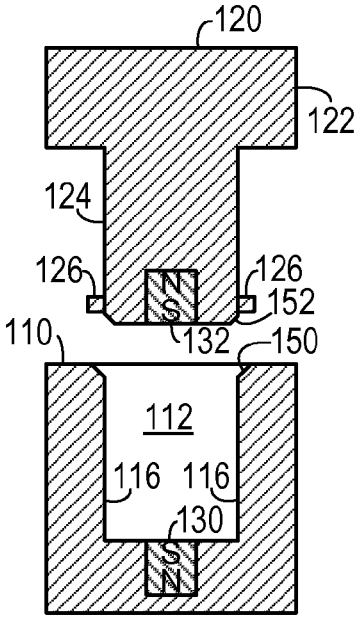
FIG. 5 is a cross-sectional view of an alternate embodiment of a clasp.

As shown in FIG. 5, the cylindrical passage 112 can include a tapered section 140 and the piston portion 124 can include a complimentary tapered section 142 to facilitate ease of mating the piston portion 124 to the cylindrical passage 112.

Figure 6:
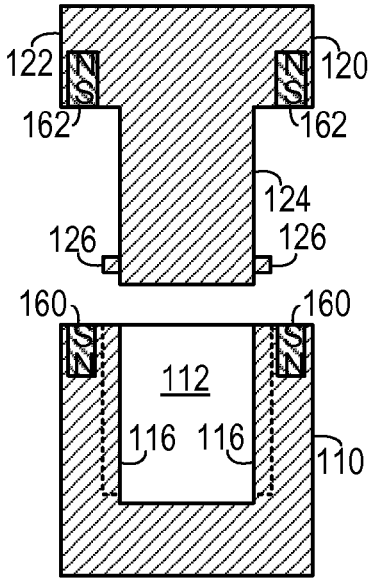
FIG. 6 is a cross-sectional view of an alternate embodiment of a clasp employing a force mechanism in the top portion.
Figure 7:
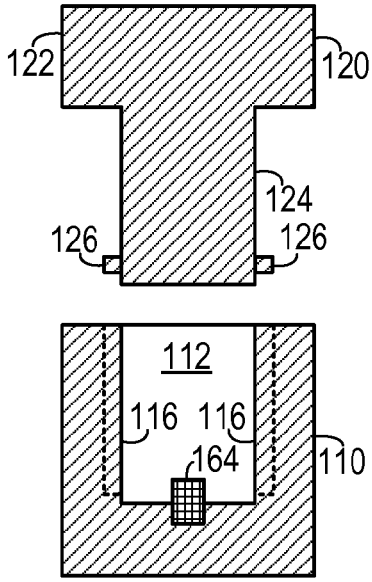
FIG. 7 is a cross-sectional view of an alternate embodiment of a clasp employing a mechanical force mechanism.

Other types of force members may be used. For example, in the embodiment shown in FIG. 6 the magnets 160 and 162 (or other force member) are disposed around the top surface of the first section 110 and the second section 120, respectively. In this embodiment, electrical wires can be run through the device and the device can be used as an electrical connector. This embodiment could be used as a quick connect for hoses as well by defining a passage through the center of the first section 110 and the second section 120 and placing an o-ring at the base of the cylindrical passage 112. In another example, as shown in FIG. 7, the force member 164 could be a spring or a springy substance, such as a piece of foam.

Figure 8A:
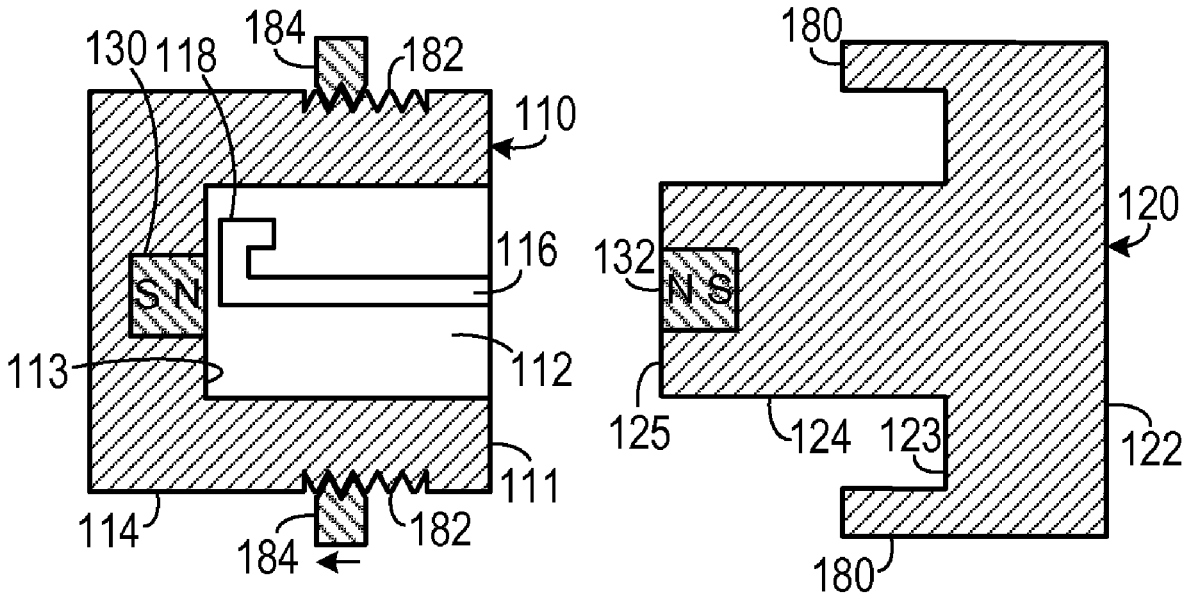
FIG. 8A is a cross-sectional view of an alternate embodiment of a clasp employing a locking mechanism in an unlocked position.
Figure 8B:
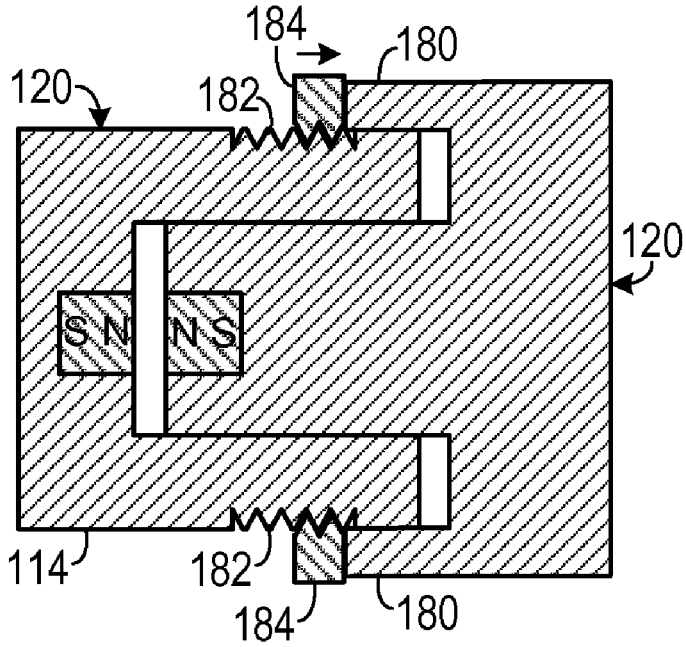
FIG. 8B is a cross-sectional view of an alternate embodiment of a clasp employing a locking mechanism in a locked position.

One embodiment, as shown in FIGS. 8A and 8B, employs a locking mechanism to prevent the first section 110 from disengaging the second section 120. The locking mechanism could be a locking device that includes a lip 180 extending from the top portion 122 of the second section 120 so that when the first section 110 is engaged with the second section 120, the lip 180 extends around a portion of the first section 110. A nut 184 includes a first plurality of threads. A second plurality of threads 182 is defined by the outer surface 114 of the first section 110 and are complimentary in shape to the first plurality of threads in the nut 184. The second plurality of threads 182 are disposed relative to the top face 111 of the first section 110 so that the nut 184 may be selectively moved toward the top face 111 by rotating it about the first section 110. Doing so prevents the second section 120 from being pushed in toward the first section 110 because the nut 184 acts as a stop. To disengage the clasp, the nut 184 is unscrewed, thereby allowing the second section 120 to be pushed in toward the first section 110.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A clasp for securing two items together, comprising:

a. a first section having a first face and defining a cylindrical passage opening to the first face, the cylindrical passage, having a base surface, defining at least one longitudinal J-shaped groove disposed longitudinally along the cylindrical passage, the J-shaped groove including a main longitudinal portion, a transverse portion in communication with the longitudinal portion and a hooked portion in communication with the transverse portion that is parallel to, and shorter than, the longitudinal portion;

b. a second section having a top portion and a piston portion extending longitudinally therefrom, the piston portion complementary in dimension to at least a portion of the cylindrical passage and having a bottom surface;

c. at least one pin extending transversely to the piston portion and complementary in dimension to at least a portion of the J-shaped groove;

d. a force mechanism that applies a repulsive force between the second section and the first section so that when the pin is aligned with the hooked portion, the repulsive force drives the pin into the hooked portion, thereby inhibiting the second section from disengaging the first section;

e. a locking mechanism that prevents the first section from being disengaged from the second section;

f. said locking mechanism comprises a locking device that prevents the first section from being pushed in toward the second section, wherein the locking device comprises:

i. a lip extending from the top portion of the second section so that when the first section is engaged with the second section, the lip extends around a portion of the first section;

ii. a nut that includes a first plurality of threads and that has an inside diameter corresponding to an outside surface of the first section; and iii. a second plurality of threads defined by the outer surface of the first section and that are complimentary in shape to the first plurality of threads, the second plurality of threads disposed relative to the top face so that the nut may be selectively moved toward the top face so as to prevent the second section from being pushed in toward the first section.

2. The clasp of claim 1, wherein the force mechanism comprises:

a. a first magnet coupled to the first section; and b. a second magnet coupled to the second section in alignment with the first magnet and disposed so that when the piston portion of the first section is disposed in the cylindrical passage the first magnet and the second magnet exert a repulsive force on each other.

3. The clasp of claim 2, wherein the first magnet is affixed adjacent to the base surface of the cylindrical passage and wherein the second magnet is affixed to the bottom surface of the piston portion.

4. The clasp of claim 2, wherein the first magnet is affixed adjacent to the first face of the bottom portion and wherein the second magnet is affixed to the bottom surface of the top portion of the second section.

5. The clasp of claim 1, wherein the force mechanism comprises a springy member disposed adjacent to the base surface of the cylindrical passage.

6. The clasp of claim 5, wherein the springy member comprises a spring.

7. The clasp of claim 5, wherein the springy member comprises a foam material.

* * * * *